United States Patent [19]

Kojima

[11] Patent Number: 5,036,822

[45] Date of Patent: Aug. 6, 1991

[54] FUEL SUPPLYING DEVICE FOR VESSEL PROPULSION UNIT

[75] Inventor: Akinori Kojima, Hamamatsu, Japan

[73] Assignee: Sanshin Kogyo Kabushiki Kaisha, Hamamatsu, Japan

[21] Appl. No.: 256,510

[22] Filed: Oct. 12, 1988

[30] Foreign Application Priority Data

Oct. 13, 1987 [JP] Japan ..... 62-258092

[51] Int. Cl.[5] ..... F02M 37/04

[52] U.S. Cl. ..... 123/509; 123/510; 123/73 AD; 417/366

[58] Field of Search ..... 123/510, 508, 198 C, 123/73 AD, 447, 497, 498, 499; 417/366, 363

[56] References Cited

U.S. PATENT DOCUMENTS

| | | | |
|---|---|---|---|
| 1,392,652 | 10/1921 | Muzzy | 123/510 |
| 4,212,600 | 7/1980 | Otto | 417/363 |
| 4,231,719 | 11/1980 | Ringwald et al. | 417/366 |
| 4,403,578 | 9/1983 | Iwai | 123/73 AD |
| 4,594,970 | 6/1986 | Baars | 123/73 AD |
| 4,617,879 | 10/1986 | Mori | 123/73 AD |
| 4,689,025 | 8/1987 | Ferguson | 123/198 C |
| 4,743,171 | 5/1988 | Mahoney | 123/73 AD |
| 4,763,633 | 8/1988 | Nakanishi | 123/509 |
| 4,811,717 | 8/1989 | Nakahama | 123/509 |

FOREIGN PATENT DOCUMENTS

| | | | |
|---|---|---|---|
| 2724412 | 11/1978 | Fed. Rep. of Germany | 123/509 |
| 3118511 | 12/1982 | Fed. Rep. of Germany | 123/510 |
| 0164768 | 12/1980 | Japan | 123/510 |
| 0062958 | 4/1982 | Japan | 123/509 |

*Primary Examiner*—Carl Stuart Miller

*Attorney, Agent, or Firm*—Ernest A. Beutler

[57] ABSTRACT

A fuel supply system for an outboard motor including a combined fuel filter and fuel pump supported within the power head of the outboard motor for drawing fuel from a remotely positioned fuel tank and delivering it to the charge forming device of the outboard motor.

4 Claims, 3 Drawing Sheets

FUEL SUPPLYING DEVICE FOR VESSEL PROPULSION UNIT

BACKGROUND OF THE INVENTION

This invention relates to a fuel supplying device for a vessel propulsion unit and more particularly to an improved and simplified fuel supplying device for an internal combustion engine.

It is well known that an internal combustion engine normally employs a charge forming device for forming a fuel/air charge for operation of the engine and a fuel tank from which fuel is supplied to the charge forming device. Normally some form of pump is required in order to cause the fuel to flow through the system from the fuel tank to the charge forming device. The provision of separate fuel pumps in the conduit interconnecting the fuel tank with the charge forming device has certain disadvantages. When the fuel pump is externally positioned, there must be connections between the fuel pump inlet and outlet and the conduit. These connections give rise to problems on assembly and can become a source of leaks. Therefore, it has been a practice to employ a submersible pump in the fuel tank for delivering the fuel from the tank to the charge forming device. Such arrangements have significant advantages.

There are, however, many applications in which a submerged fuel pump in the fuel tank is not an acceptable alternative. For example, in connection with marine propulsion units and particularly outboard motors, it is normally the practice to provide a fuel tank that is remote from the engine and which is designed to be contained within the hull of the watercraft. Fuel is supplied from this tank to the charge forming device of the power head of the outboard motor through a conduit. If the fuel pump is contained within the fuel tank, this means that electrical power may have to be supplied from the engine to the remotely positioned fuel tank and, furthermore, it also means that a given fuel tank and engine must always be used together. That is, the provision of the fuel pump in the fuel tank requires that the engine that is used with the fuel tank be designed so as to accept such a remotely positioned fuel pump. Also, if the engine is designed to be used with a remotely positioned fuel tank in which the fuel pump is provided, it cannot be readily used on another watercraft that does not have a fuel tank with a fuel pump in it.

It is, therefore, a principal object of this invention to provide an improved fuel supplying device for a vessel propulsion unit.

It is a further object of this invention to provide an improved arrangement for supplying fuel to the charge forming device of an internal combustion engine from a remote fuel tank.

It is a still further object of this invention to provide an improved arrangement wherein a submersible pump can be used in the fuel supply system for an internal combustion engine but need not be submerged in the fuel tank of the engine.

The requirement for compact constructions in outboard motors is well known. If it is desired to provide a fuel pump in the outboard motor, in addition to the aforenoted problems of possible leakage and the use of external connections, the separate fuel pump adds to the spacial requirements of the components of the engine.

It is, therefore, a still further object of this invention to provide an improved and compact fuel pump arrangement for an internal combustion engine such as an outboard motor.

SUMMARY OF THE INVENTION

A first feature of this invention is adapted to be embodied in a fuel supply device for an internal combustion engine that is comprised of a fuel tank, a charge forming device for the engine and conduit means interconnect the fuel tank with the charge forming device for the flow of fuel therethrough. In accordance with this feature of the invention, the conduit means defines a reservoir volume in which a quantity of fuel may accumulate and a fuel pump is submerged in that reservoir volume for pumping fuel through the conduit means from the fuel tank to the charge forming device.

Another feature of this invention is adapted to be embodied in a combined fuel pump and filter assembly for an internal combustion engine. Such a combined assembly includes a housing in which a fuel filter element is located and an inlet and outlet to the housing. The housing, fuel filter element and inlet and outlet are disposed so that fuel must flow through the fuel filter element as it passes from the inlet to the outlet. In accordance with this feature of the invention, a fuel pump is contained within the filter housing for pumping fuel from the inlet to the outlet.

DETAILED DESCRIPTION OF THE PREFERRED EMBODIMENT

Figure 1:
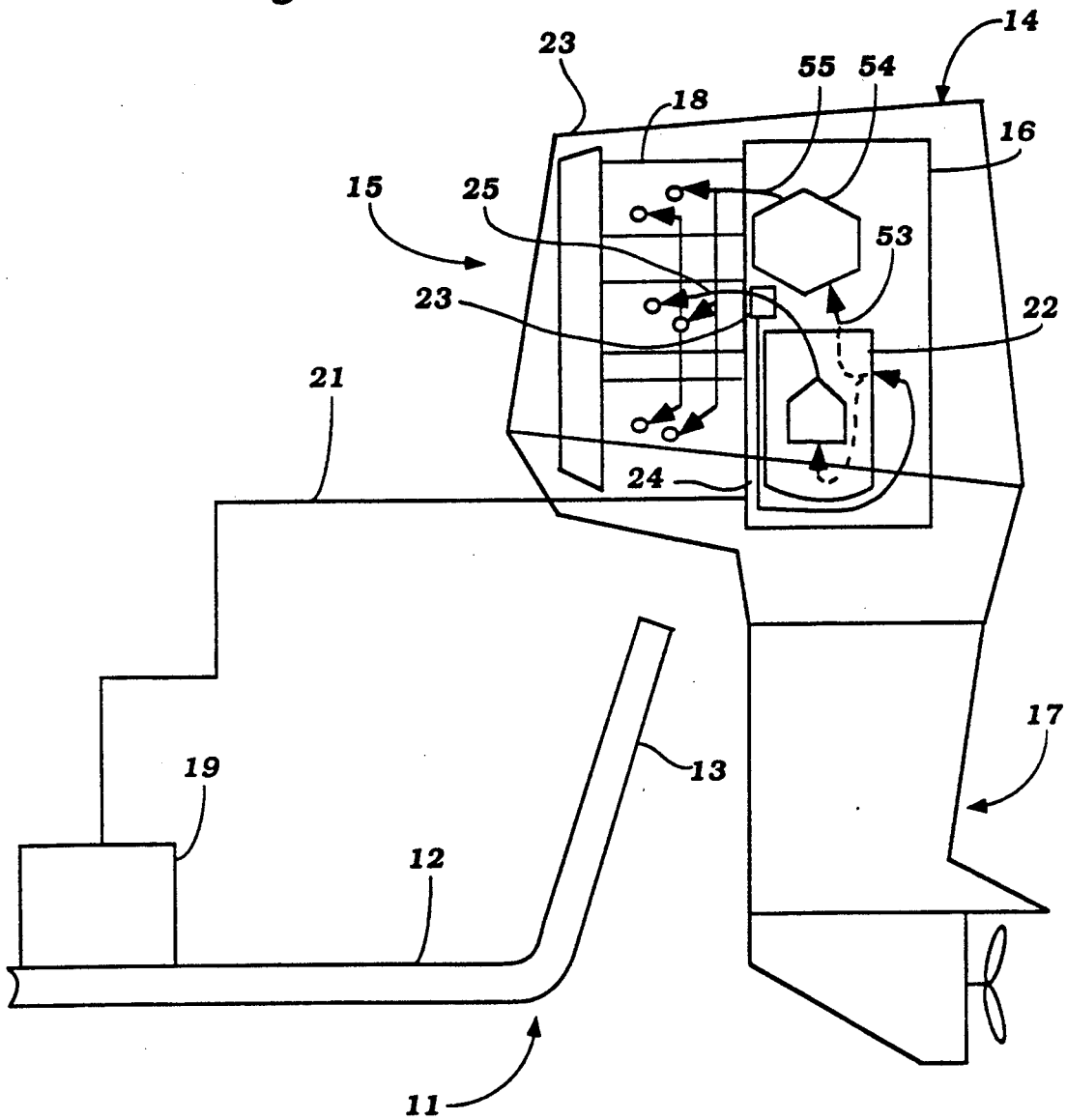
FIG. 1 is a partially schematic side elevational view of an outboard motor and associated watercraft showing an embodiment of the invention.

Referring first to FIG. 1, a watercraft and associated outboard motor is identified generally by the reference numeral 11. This combination includes a hull 12 having a transom 13 upon which an outboard motor, indicated generally by the reference numeral 14, is mounted for normal steering and tilting movement. Since this mounting arrangement may take any conventional form, it is not illustrated in detail. The outboard motor 14 is comprised of a power head assembly, indicated generally by the reference numeral 15 and which comprises an internal combustion engine 16 which may be of any known type. The engine 16 drives a drive shaft and propulsion unit (not shown) which are contained within a drive shaft and lower unit housing assembly, indicated at 17. Since this portion of the construction of the outboard motor 14 is conventional and forms no part of the invention, detailed illustration of it is believed to be unnecessary.

The engine 16 is provided with a charge forming device such as a carburetor or carburetors or a fuel injection system, which is shown schematically at 18. Fuel is supplied to the charge forming device 18 from a remotely positioned fuel tank 19 which is supported within the watercraft hull 12 through a conduit 21 including a quick disconnect coupling (not shown) at the power head 15. The conduit 21 delivers fuel to a combined fuel filter and pumping assembly 22 which is contained within a protective cowling 23 of the power head 15. The fuel filter and pumping assembly 22 delivers fuel to a pressure regulator 23 which controls pressure by returning excess fuel back to the conduit 21 through a return conduit 24. The regulated fuel from the regulator 23 is then delivered to a starting circuit of the charge forming devices 18 through a delivery conduit 25.

Figure 2:
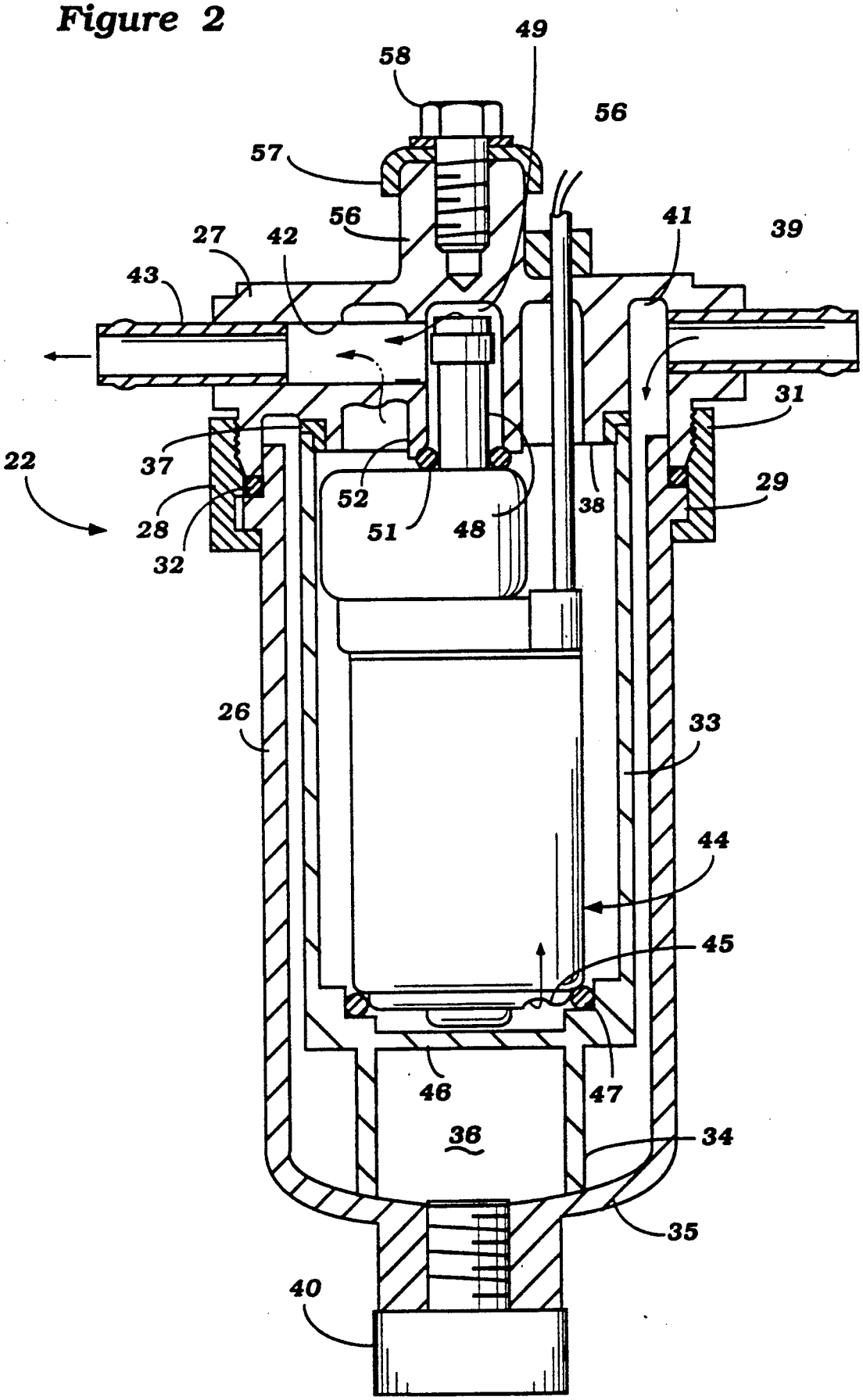
FIG. 2 is an enlarged vertical cross-sectional view showing the combined fuel filter, submerged fuel pump of this embodiment taken along the line 2—2 of FIG. 3.
Figure 3:
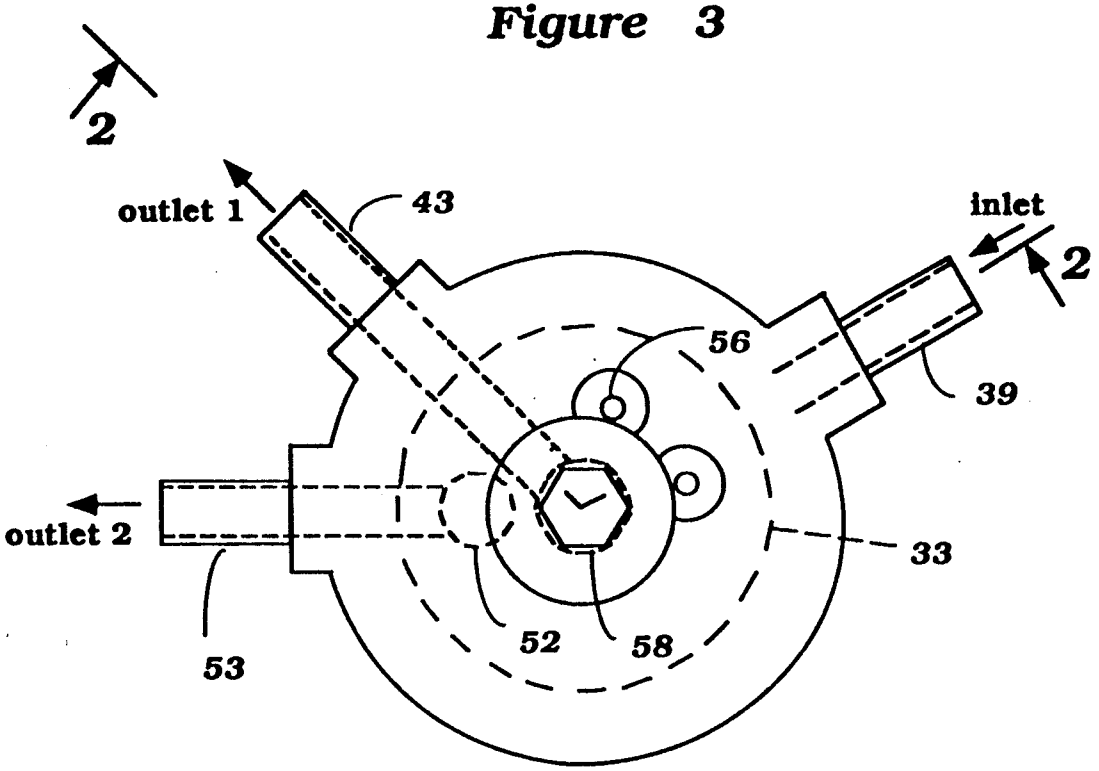
FIG. 3 is a top plan view of the fuel filter, submerged fuel pump.

Referring now in detail to FIGS. 2 and 3, the construction of the combined fuel filter and fuel pump 22 will be described in detail. The combined element 22 is comprised of a generally cylindrical casing 26 that is affixed to a cap 27 by means of a coupling 28. The coupling 28 cooperates with a flange 29 formed on the upper end of the casing 26 and is threaded onto a threaded portion 31 of the cap 27 for securing the elements together. An O-ring seal 32 is provided at the joint between the flange 29 and threaded portion 31 of the cap 27 so as to provide a fluid tight seal and to define an internal reservoir cavity.

A generally cylindrical filter element 33 is contained within this internal reservoir and has a base portion 34 that is engaged with a lower wall 35 of the housing 26. This base portion 34 is provided with openings so as to permit liquid to enter into a chamber 36 formed by the base 34. The upper end of the filter element 33 is open and is engaged with a seal 37 held by an extension 38 of the cap 27 so as to effect a fluid tight seal. The filter element 33 is of the hydrophobic type so that it will separate water from the fuel that flows through it. This separated water will accumulate in the cavity 36 and can be drained periodically by the removal of a drain plug 40.

Fuel flows through the filter element 33 from an inlet fitting 39 that is carried by the cap 27 and which communicates with an inlet passage 41 formed in the cap 27 so as to admit fuel around the outer periphery of the element 33. Fuel is then discharged, in a manner to be described, through a discharge passageway 42 formed in the cap and which communicates with a discharge fitting 43. The inlet fitting 39 cooperates with the conduit 22 (FIG. 1) and the outlet fitting 43 communicates with a conduit that delivers fuel to the pressure regulator 23 and then to the starting circuits of the charge forming device 18.

In order to deliver fuel from the remotely positioned tank 19 to the charge forming devices 18, a submersible electric fuel pump 44 is contained within the reservoir defined by the housing 26 and cap 27. Specifically in the illustrated embodiment, the fuel pump 44 is contained within the hollow interior of the filter element 33. The fuel pump 44 has a lower wall having an inlet fitting 45 that is supportingly engaged by an imperforate lower wall 46 of the filter element 33 through an O-ring seal 47 that supports the fuel pump but prevents leakage in this area so that filtered fuel may flow to the pump inlet 45.

The fuel pump 44 has a first discharge fitting 48 that extends through a central passageway 49 formed in the cap 27. An O-ring seal 51 sealingly engages the upper portion of the fuel pump 44 around its outlet fitting 48 so that pressurized fuel can flow into the discharge conduit 42 and fitting 43. A second passageway 52 is formed in the cap 27 so as to permit fuel to bypass the pump 44 and to flow through a second outlet fitting 53 to a fuel pump 54 that is driven mechanically or otherwise by the operation of the engine 16. The pump 54 supplies normal running fuel to the charge forming devices 18 through a conduit 55.

The cap 27 has a boss portion 56 that permits mounting to the side of the engine 16 by means of an engine mounted mounting bracket 57 and threaded fastener 58.

An electrical conductor 56 extends through the cap 27 and to the electric fuel pump 44 for permitting its operation.

It should be readily apparent from the foregoing description that the combined fuel filter and fuel pump assembly 22 provides not only a reservoir for fuel in the power head 15 of the outboard motor but also provides a compact assembly and permits the use of a submersible fuel pump which reduces the number of external fittings which must be sealed. Also, it permits the outboard motor 14 to be utilized with any remotely positioned fuel tank and, therefore, the system is in effect self-contained.

The foregoing description is that of a preferred embodiment of the invention and various changes and modifications may be made without departing from the spirit and scope of the invention, as defined by the appended claims. For example, the description is of an application with both electrical and engine driven fuel pumps but the invention may be used in application having only an electrical or submerged pump.

I claim:

1. In a fuel supplying device for an outboard motor adapted to be mounted on the transom of a watercraft hull and having an internal combustion engine, said device being comprised of a fuel tank positioned within the hull, a charge forming device for said engine and conduit means interconnecting said fuel tank with said charge forming device for the flow of fuel thereto, the improvement comprising said conduit means defining a reservoir volume formed in the power head of said outboard motor and a fuel filter therein in which a quantity of fuel may accumulate, and a fuel pump submerged in said reservoir volume of said fuel filter for pumping fuel through said conduit means from said fuel tank to said charge forming device.

2. In a fuel supply device as set forth in claim 1 wherein the fuel filter comprises a cylindrical element and is contained within a housing having a cap and a cylindrical housing portion, the fuel pump having a discharge fitting sealingly engaged with the cap for delivering fuel under pressure to an outlet passage formed in the cap.

3. A combined fuel filter and fuel pump arrangement comprised of a housing assembly defining a reservoir volume, an inlet to said reservoir volume, an outlet from said reservoir volume, a cylindrical fuel filter element supported within said housing assembly and disposed between said inlet and said outlet for filtering fuel flowing therethrough, and a fuel pump and drive motor therefore contained within the interior of said cylindrical fuel filter and in said reservoir volume for drawing fuel from said inlet and discharging it through said outlet.

4. A combined fuel filter and fuel pump arrangement as set forth in claim 3 wherein the housing assembly comprises a cap and a cylindrical housing portion, the fuel pump having a discharge fitting sealingly engaged with the cap for delivering fuel under pressure to the outlet which is formed in the cap.

* * * * *